US006216799B1

(12) United States Patent
Gonzalez

(10) Patent No.: US 6,216,799 B1
(45) Date of Patent: Apr. 17, 2001

(54) SUBSEA PUMPING SYSTEM AND METHOD FOR DEEPWATER DRILLING

(75) Inventor: Romulo Gonzalez, Slidell, LA (US)

(73) Assignee: Shell Offshore Inc., New Orleans ( * ) Notice: Subject to any disclaimer, the term of this patent is extended or adjusted under 35 U.S.C. 154(b) by 0 days.

(21) Appl. No.: 09/160,773

(22) Filed: Sep. 24, 1998

Related U.S. Application Data

(60) Provisional application No. 60/060,042, filed on Sep. 25, 1997.

(51) Int. Cl.[7] ..... E21B 7/12; E21B 15/02

(52) U.S. Cl. ..... 175/5; 175/7; 175/57; 175/206; 175/207; 175/318; 166/357

(58) Field of Search ..... 175/57, 5, 7, 206, 175/207, 317, 318, 724; 166/357, 267

(56) References Cited

U.S. PATENT DOCUMENTS

| | | | | |
|---|---|---|---|---|
| 2,808,230 | | 10/1957 | McNeill et al. | 255/2.5 |
| 2,870,990 | * | 1/1959 | Bergey | 175/66 |
| 2,923,531 | | 2/1960 | Bauer et al. | 255/2.5 |
| 3,434,550 | | 3/1969 | Townsend, Jr. | 175/5 |
| 3,465,817 | | 9/1969 | Vincent | 166/5 |
| 3,498,674 | * | 3/1970 | Matthews | 175/209 X |
| 3,603,409 | | 9/1971 | Watkins | 175/7 |
| 3,621,912 | * | 11/1971 | Wooddy, Jr. | 166/340 |
| 3,815,673 | * | 6/1974 | Bruce et al. | 175/7 X |
| 3,911,740 | | 10/1975 | Calhoun | 73/153 |
| 4,063,602 | | 12/1977 | Howell et al. | 175/7 |
| 4,091,881 | * | 5/1978 | Maus | 175/7 |
| 4,099,583 | | 7/1978 | Maus | 175/7 |
| 4,147,221 | * | 4/1979 | Ilfrey et al. | 175/7 |
| 4,149,603 | | 4/1979 | Arnold | 175/7 |
| 4,253,530 | * | 3/1981 | Sharki et al. | 175/48 X |
| 4,295,366 | * | 10/1981 | Gibson et al. | 175/48 X |
| 4,350,591 | | 9/1982 | Lee | 210/384 |
| 4,430,892 | * | 2/1984 | Owings | 175/48 X |
| 4,506,735 | | 3/1985 | Chaudot | 166/357 |
| 4,527,632 | | 7/1985 | Chaudot | 166/357 |
| 4,546,783 | | 10/1985 | Lott | 134/109 |
| 4,639,258 | | 1/1987 | Schellstede et al. | 55/52 |
| 4,705,114 | | 11/1987 | Schroeder et al. | 166/357 |
| 4,813,495 | | 3/1989 | Leach | 175/6 |
| 4,982,794 | | 1/1991 | Houot | 166/357 |
| 5,079,949 | * | 1/1992 | Gavignet | 175/48 |
| 5,417,544 | | 5/1995 | Mohn | 415/64 |
| 5,460,227 | | 10/1995 | Sidrim | 166/357 |
| 5,657,823 | * | 8/1997 | Kogure et al. | 166/340 |
| 5,803,185 | * | 9/1998 | Barr et al. | 175/45 |
| 5,975,219 | * | 11/1999 | Sprehe | 175/48 |

OTHER PUBLICATIONS

Allen Gault, "Riserless drilling: circumventing the size/cost cycle in deepwater," Drilling Technology, *Offshore*, May 1996, 4 pages.

Rich Van Flatern, Drilling & Production, *Offshore*, Feb. 1997, p. 26.

Larry Comeau, "Integrating surface systems with downhole data improves underbalanced drilling", Practical Drilling Technology, *Oil and Gas Journal*, Mar. 3, 1997, pp. 56–64.

(List continued on next page.)

*Primary Examiner*—Eileen D. Lillis
*Assistant Examiner*—Jong-Suk Lee

(57) ABSTRACT

A method is disclosed for offshore drilling in which a bit is driven at a far end of a drill string, drilling fluid is injected into the drill string from surface drilling facilities, and drilling fluid passes through the far end of the drill string and flushes the borehole at the bit and entrains cuttings into the drilling fluid which circulates up the casing/drill string annulus. The drilling fluid drawn off near the mudline and is treated through a subsea primary processing stage to removing the cuttings from the drilling fluid. The treated drilling fluid is then returned to the surface with a subsea return pump system and passes to surface drilling facilities for injection and recirculation.

55 Claims, 8 Drawing Sheets

OTHER PUBLICATIONS

Geoff Whitehouse and Peter Stefureak, "Closed surface system allows accurate monitoring of drilling returns, " *Oil and Gas Journal*, Mar. 3, 1997, pp. 65–67.
Steven S. Bell, "Riserless drilling promising for deepwater developments, "What's Happening in Drilling, *World Oil*, May 1997, p. 33.
W. Furlow, "Shell Moves Forward With Dual Gradient Deepwater Drilling Solution", Offshore, Mar. 2000, p. 54.
R. von Flatern, "Riserless Rivals Rally to the Cause", Offshore Engineer, Apr. 2000, p. 20.
K. L. Smith et al, "SubSea Mudlift Drilling JIP: Achieving Dual Gradient Technology", Deepwater Technology, Gulf Publishing, pp. 21–28, Aug. 1999.
"Riserless Drilling Project Develops Critical New Technology/Deepwater Technology Symposium", by Rober E. Snyder World Oil. pp. 1–11, Dec. 1997.
"MudLift Drilling System Operations", by Riley Goldsmith, pp. 1–9, presented at the OTC Conference on May. 4–7, 1998.
"Riserless Drilling and Well Control for Deep Water Applications", by Jonggeum Choe et al., presented at the Internation Deep Water Well Control Conference on Sep. 15–16, 1997, pp. 1–9.

"Subsea Mudlift Drilling JIP: Achieving dual gradient technology", by K. L. Smith et al., Deepwater Technology, pp. 21–28.

"*Riserless* rivals rally to the cause", Offshore Engineer, Apr. 2000, pp. 20–23.

"Shell moves forward with dual gradient deepwater drilling solution", Willaim Furlow, Offshore, Mar. 2000, pp. 95–96.

"Riserless Drilling JIP/Conceptual Engineering" Jul. 30, 1997, Deepwater Drilling Workshop, MMS–LSU (Baton Rouge).

* cited by examiner

FIG. 3
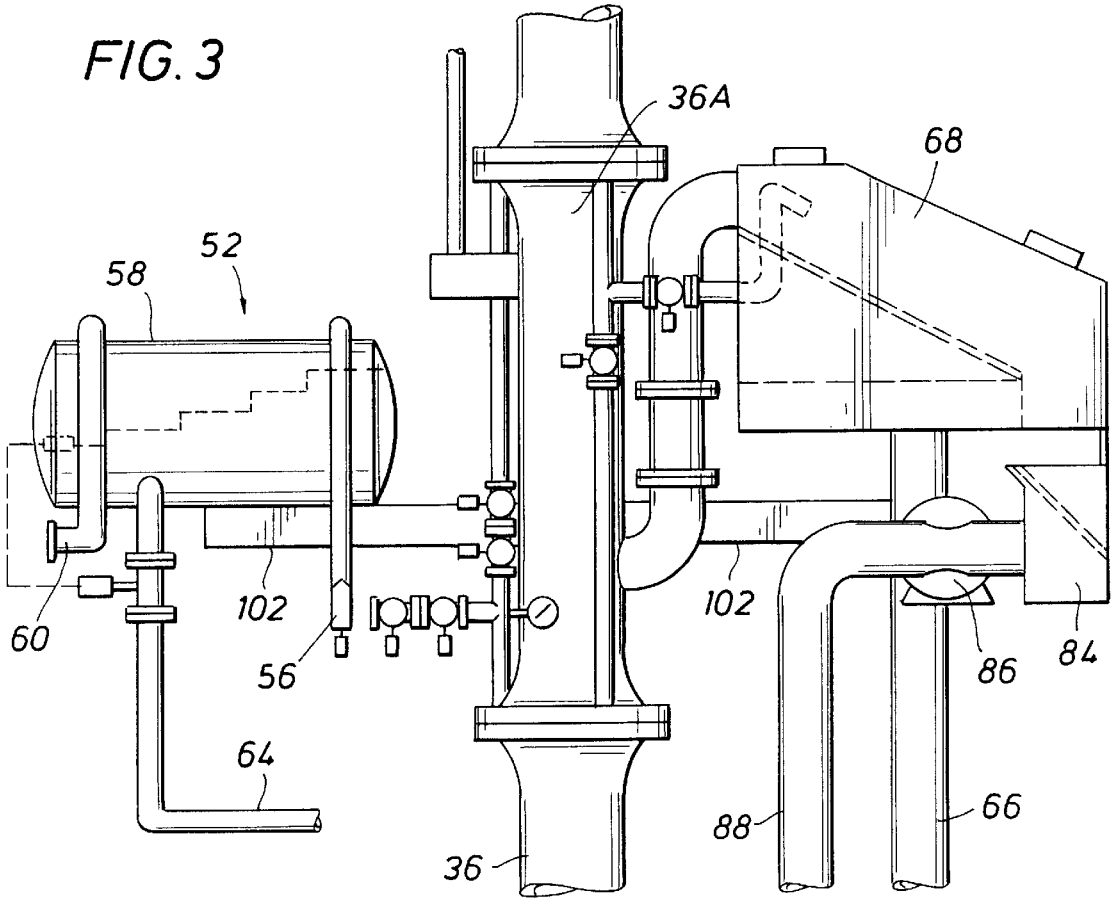
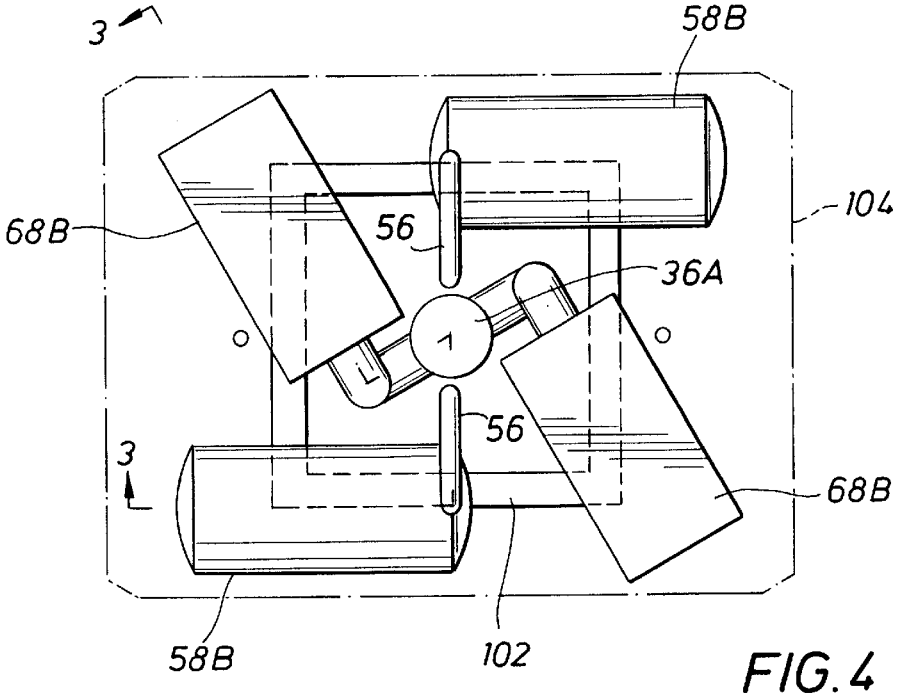
FIG. 4

SUBSEA PUMPING SYSTEM AND METHOD FOR DEEPWATER DRILLING

This application claims the benefit of U.S. Provisional Application No. 60/060,042, filed Sep. 25, 1997, the entire disclosure of which is hereby incorporated by reference.

BACKGROUND OF THE INVENTION

The present invention relates to drilling systems and operations. More particularly, the present invention is a method and system for handling the circulation of drilling mud in deepwater offshore drilling operations.

Drilling fluids, also known as muds, are used to cool the drill bit, flush the cuttings away from the bit's formation interface and then out of the system, and to stabilize the borehole with a "filter cake" until newly drilled sections are cased. The drilling fluid also performs a crucial well control function and is monitored and adjusted to maintain a pressure with a hydrostatic head in uncased sections of the borehole that prevents the uncontrolled flow of pressured well fluids into the borehole from the formation.

Conventional offshore drilling circulates drilling fluids down the drill string and returns the drilling fluids with entrained cuttings through an annulus between the drill string and the casing below the mudline. A riser surrounds the drill string starting from the wellhead at the ocean floor to drilling facilities at the surface and the return circuit for drilling mud continues from the mudline to the surface through the riser/drill string annulus.

In this conventional system, the relative weight of the drilling fluid over that of seawater and the length of the riser in deepwater applications combine to exert an excess hydrostatic pressure in the riser/drill string annulus.

Systems have been conceived to bring the drilling fluid and entrained cuttings out of the annulus at the base of the riser and to deploy a subsea pump to facilitate the return flow through a separate line. One such system is disclosed in U.S. Pat. No. 4,813,495 issued Mar. 21, 1989 to Leach. That system requires complex provisions to ensure the closely synchronous operation of the supply and return pumps critical to the approach disclosed. However, the durability and dependability of such a mud circulation system is suspect in the offshore environment and particularly so in light of the nature of the fluid with entrained cuttings that is handled in valves and pumps on the return segment of the circuit.

Thus, there remains a need for a practical means for reducing the excess hydrostatic pressure exerted by the mud column return in the riser/drill string annulus.

An advantage of the present system and method is that it is not necessary to maintain strict synchronous operation of the supply and return lines. Another advantage is that working environment of the return pump and associated valves is materially improved, enhancing pump and valve life and performance.

A SUMMARY OF THE INVENTION

One aspect of the present invention is a method for offshore drilling which drives a bit mounted at a far end of a drill string, injects a drilling fluid into the drill string from surface drilling facilities, passes the drilling fluid through the far end of the drill string and flushes the borehole at the bit and entraining cuttings into the drilling fluid. The drilling fluid is treated through a subsea primary processing stage to removing the cuttings from the drilling fluid and the treated drilling fluid is returned to the surface with a subsea return pump system and passes to surface drilling facilities for injection.

A BRIEF DESCRIPTION OF THE DRAWINGS

The brief description above, as well as further objects and advantages of the present invention, will be more fully appreciated by reference to the following detailed description of the preferred embodiments which should be read in conjunction with the accompanying drawings in which:

FIG. 3 is a side elevational view of the dedicated riser section in the embodiment of FIG. 2;

FIG. 4 is a top elevational view of the dedicated riser section of FIG. 3;

BRIEF DESCRIPTION OF ILLUSTRATIVE EMBODIMENTS

Figure 1:
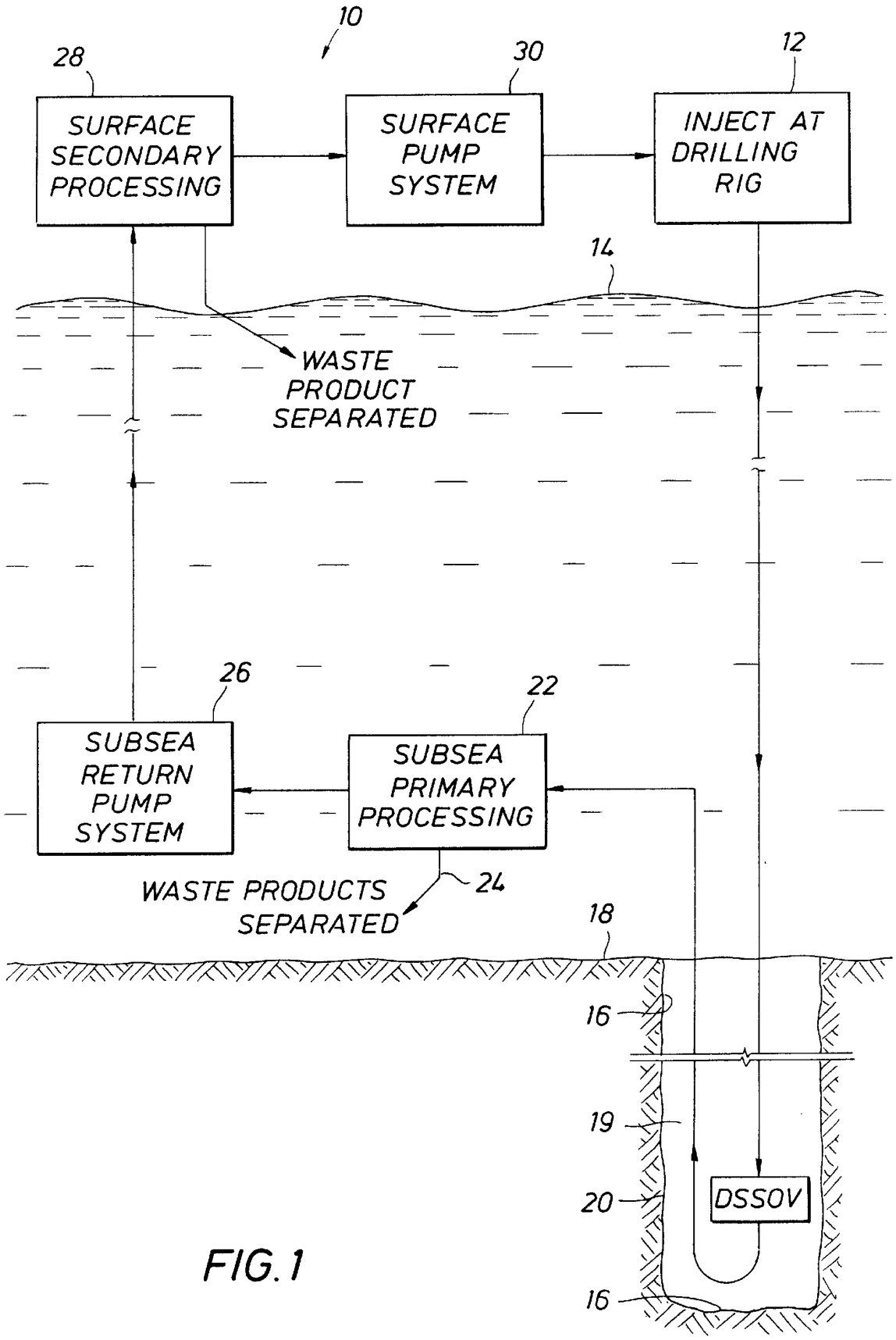
FIG. 1 is a schematic illustration of one embodiment of a subsea pumping system for deepwater drilling.

FIG. 1 illustrates schematically one embodiment of a drilling fluid circulation system 10 in accordance with the present invention. Drilling fluid is injected into the drill string at the drilling rig facilities 12 above ocean surface 14. The drilling fluid is transported down a drill string (see FIG. 2), through the ocean and down borehole 16 below mudline 18. Near the lower end of the drill string the drilling fluid passes through a drill string shut-off valve ("DSSOV") 20 and is expelled from the drill string through the drill bit (refer again to FIG. 2). The drilling fluid scours the bottom of borehole 16, entraining cuttings, and returns to mud line 18 in annulus 19. Here, near the ocean floor, the drilling mud is carried to a subsea primary processing facility 22 where waste products, see line 24, are separated from the drilling fluid. These waste products include at least the coarse cuttings entrained in the drilling fluid. With these waste products 24 separated at facilities 22, the processed drilling fluid proceeds to subsea return pump 26 where it is pumped to drilling facilities above surface 14. A secondary processing facility 28 may be employed to separate additional gas at lower pressure and to remove fines from the drilling fluid. The reconditioned drilling fluid is supplied to surface pump system 30 and is ready for recirculation into the drill string at drilling rig 12. This system removes the mud's hydrostatic head between the surface and the seafloor from the formation and enhances pump life and reliability for subsea return pump system 26.

The embodiment of FIG. 1 can be employed in both drilling operations with or without a drilling riser. In either case, the hydrostatic pressure of the mud return through the water column is isolated from the hydrostatic head below the blowout preventor, near the seafloor. Indeed, with sufficient isolation the return path for the mud could proceed up the drilling riser/drill string annulus. However, it may prove convenient to have a separate riser for mud return whether or not a drilling riser is otherwise employed. Further, even if not used as the mud return line through the water column, it may be convenient to have a drilling riser to run the blowout preventor and separation equipment discussed below. See FIG. 2.

Returning to FIG. 1, another advantage of this embodiment is that gas resulting from a well control event is removed at gas separator 52 and is expelled near seafloor 18. Pump operation in such well events is critical. In a well control event in which large volumes of gas enter the well, the overall system must handle gas volumes while creating an acceptable back pressure on the wellbore 16 by pumping down heavier weight mud at sufficient volume, rate and pressure. Dropping below this pressure in a well control event will result in additional gas influx, while raising pressure to excess may fracture the borehole. The ability to cycle through muds at weights suited to the immediate need is the primary control on this critical pressure. However, multiphase flow is a challenge to conventional pumps otherwise suited to subsea return pump system 26. Thus, only substantially gas free mud is pumped to the surface through subsea return pump system 26, facilitating pump operation during critical well control events. Additional gas may be removed at the surface atmospheric pressure with an additional gas separation system, not shown.

Figure 2:
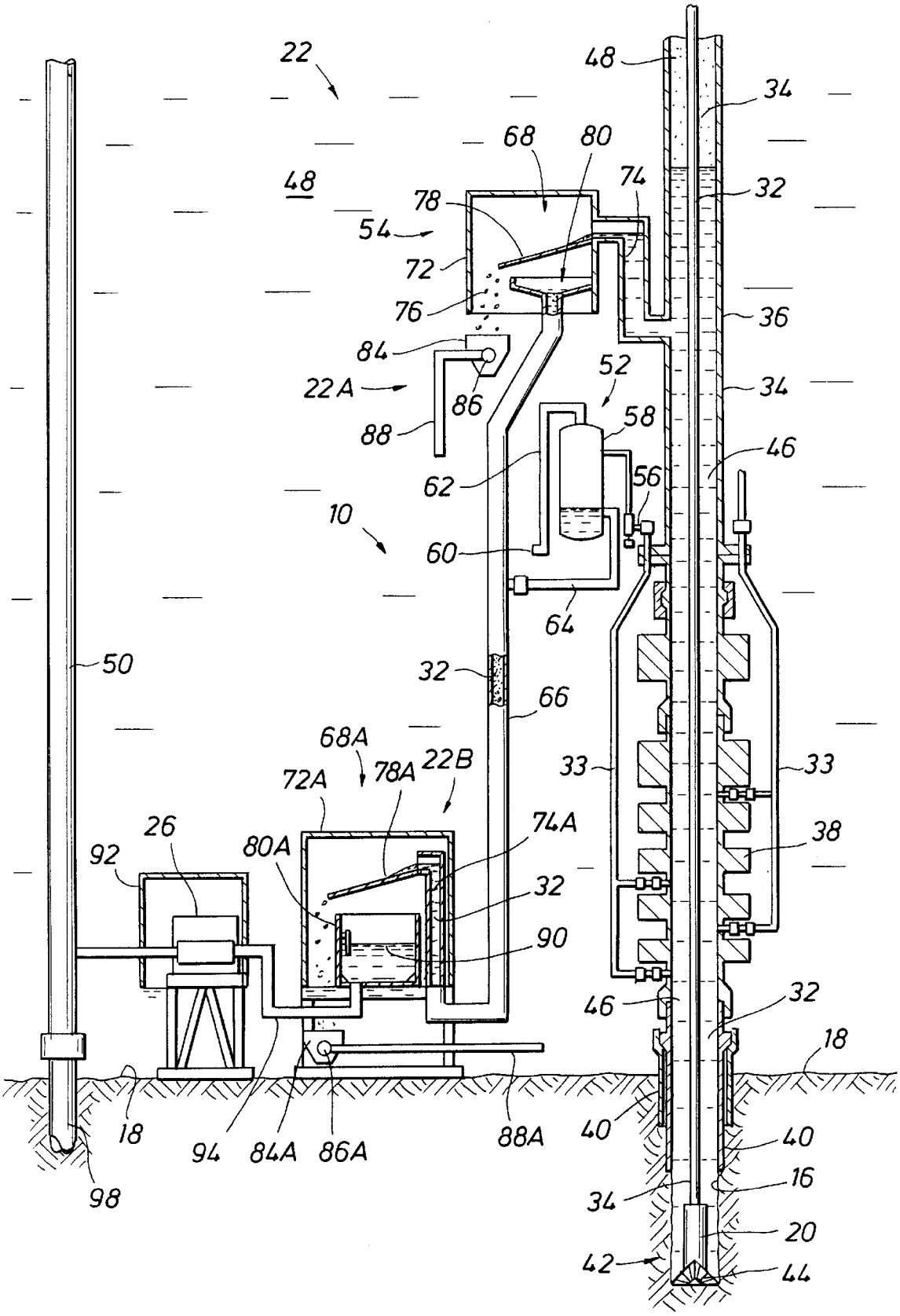
FIG. 2 is a side elevational view of a one embodiment of a subsea pumping system for deepwater drilling.

FIG. 2 illustrates the subsea components of one embodiment of drilling fluid circulation system 10, here with a drilling riser that is not used for returning the mud through the water column. The drilling fluid or mud 32 is injected into drill string 34 which runs within marine drilling riser 36, through a subsea blow-out preventor ("BOP stack") 38 near the mudline 18, through casing 40, down the uncased borehole 16 to a bottom hole assembly 42 at the lower end of the drill string. In this embodiment, the bottom hole assembly includes DSSOV 20 as well as drill bit 44.

The flow of drilling mud 32 through drill string 34 and out drill bit 44 serves to cool the drill bit, flush the cuttings away from the bit's formation interface and to stabilizes the uncased borehole with a "filter cake" until additional casing strings 40 are set in newly drilled sections. Drilling mud 32 also performs a crucial well control function in maintaining a pressure with a hydrostatic head in uncased sections of the borehole 16 that prevents the uncontrolled flow of pressured well fluids into the borehole from the formation.

However, in this embodiment, the drilling mud is not returned to the surface through the marine riser/drill string annulus 46, but rather is withdrawn from the annulus near mudline 18, e.g., immediately above BOP stack 38 through mud return line 74. In this illustration, with a drilling riser, the remainder of annulus 46, to the ocean surface, is filled with seawater 48 which is much less dense than the drilling mud. Deepwater drilling applications may exert a thousand meters or more of hydrostatic head at the base of marine drilling riser 36. However, when this hydrostatic head is from seawater rather than drilling mud in annulus 32, the inside of the marine drilling riser remains substantially at ambient pressure in relation to the conditions outside the riser at that depth. The same is true for mud leaving the well bore in riserless embodiments. This allows the drilling mud specification to focus more clearly on well control substantially from the mudline down.

Drilling mud 32 is returned to the surface in drilling fluid circulation system 10 through subsea primary processing 22, subsea return pump 26 and a second riser 50 serving as the drilling mud return line. In this embodiment, subsea primary processing 22 is illustrated with a two component first stage 22A carried on the lowermost section of drilling riser 36 and a subsequent stage 22B on the ocean floor.

In normal operation, solids removal system 54 first draws the return of drilling mud 32. Here solids removal system 54 is a gumbo box arrangement 68 which operates in a gas filled ambient pressure dry chamber 72. The hydrostatic head of mud 32 within the annulus 46 drives the mud through the intake line and over weir 74 to spill out over cuttings removal equipment such screens or gumbo slide 78. Cuttings 76 too coarse to pass between bars or through a mesh screen proceed down the gumbo slide, fall off its far edge beyond mud tank 80, and exit directly into the ocean through the open bottom of dry chamber 72. The mud, less the cuttings separated, passes through the gumbo slide and is received in mud tank 80 and exits near the tank base.

Remote maintenance within gumbo-box arrangement 68 may be facilitated with a wash spray system to wash the gumbo slide with seawater and a closed circuit television monitor or other electronic data system in the dry chamber.

Cuttings 76 can be prevented from accumulation at the well by placing a cuttings discharge ditch 84 beneath dry chamber 72 to receive cuttings exiting the dry chamber (and perhaps the dump valve). A jet pump 86 injects seawater past a venturi with a sufficient pressure drop to cause seawater and any entrained cuttings to be drawn into cuttings discharge line 88 from cuttings discharge ditch 84. The cuttings discharge line then transports the cuttings to a location sufficiently removed such that piles of accumulated cuttings will not interfere with well operations.

FIGS. 3 and 4 illustrate in detail an alternate embodiment in which components of first and second stage processing 22A and 22B as well as gas separator 52 are mounted on a dedicated riser section 36A. The dedicated riser needs to be sized to be run through the moonpool of the surface drilling facilities, preferably having a horizontal cross section no greater that the BOP stack outline 104, illustrated in FIG. 4 in dotted outline 100.

Components, here a pair of gumbo boxes 68 and a pair of horizontal gas/mud separators 58, are mounted on frame 102 secured to dedicated riser joint 36A. Cuttings discharge ditches 84, jet pumps 86, and cuttings discharge lines 88 are also mounted to this riser section. This allows connections between these initial components and the annulus within marine drilling riser 36 and BOP stack 38 to be fully modularly assembled on the surface before the drilling riser is made up to the subsea well.

Returning to FIG. 2, the illustrated embodiment also provides subsequent stage processing 22B, here a further solids removal system 54A, in the form of a second gumbo box arrangement 68A in gas-filled ambient pressure dry chamber 72A. The hydrostatic head of mud 32 within tank 80 drives the mud and over weir 74A to spill out mud and entrained cuttings over more closely spaced bars or a finer mesh screen gumbo slide 78A. Mud separated in mud/gas separator 52 may join that from tank 80 in this second stage processing. A finer grade of cuttings is removed and carried away with cuttings discharge ditch 84A and jet pump 86B, as before, with the processed mud passing to mud tank 80A.

It may also be desirable to provide the position of normal tank exit and a tank volume that allows settling of additional cuttings able to pass through the gumbo slide. A surface activated dump valve 82 at the very bottom of the mud tank may be used to periodically remove the settled cuttings.

The suction line 94 of subsea return pump 26 is attached to the base of mud tank 80A. A liquid level control 90 in the mud tank or subsequent subsea mud reservoir activates return pump. The removal of the cuttings from the mud greatly enhances pump operation in this high pressure pumping operation to return the cuttings from the seafloor to the facilities above the ocean surface through a return riser 50. The return riser may be conveniently secured at its base to a foundation such as an anchor pile 98 and supported at its upper end by surface facilities (not shown), perhaps aided by buoyancy modules (not shown) arranged at intervals along its length. A return pump is provided to propel the mud up the return riser to the surface. A suitable pump may be deployed into the subsea environment or, as in this embodiment, the return pump can be housed in an ambient pressure dry chamber 92 which improves the working environment and simplifies pump design and selection. In well control events, BOP stack 38 is closed and the gas separator 52 intakes from subsea choke lines 33 associated with BOP stack 38. The intake leads to a vertically oriented tank or vessel 58 having an exit at the top which leads to a gas vent 60 through an inverted u-tube arrangement 62 and a mud takeout 64 near its base which is connected into return line 66 downstream from solids removal system 54. In such a well control event, gas separator 52 permits removal of gas from mud 32 so that subsea pump system 26 may operate with only a single phase component, i.e., liquid mud. The gas separator 52 may be conveniently mounted to the lowermost riser section 36 or, as illustrated in FIGS. 3 and 4, a dedicated riser section 36A.

Figure 5:
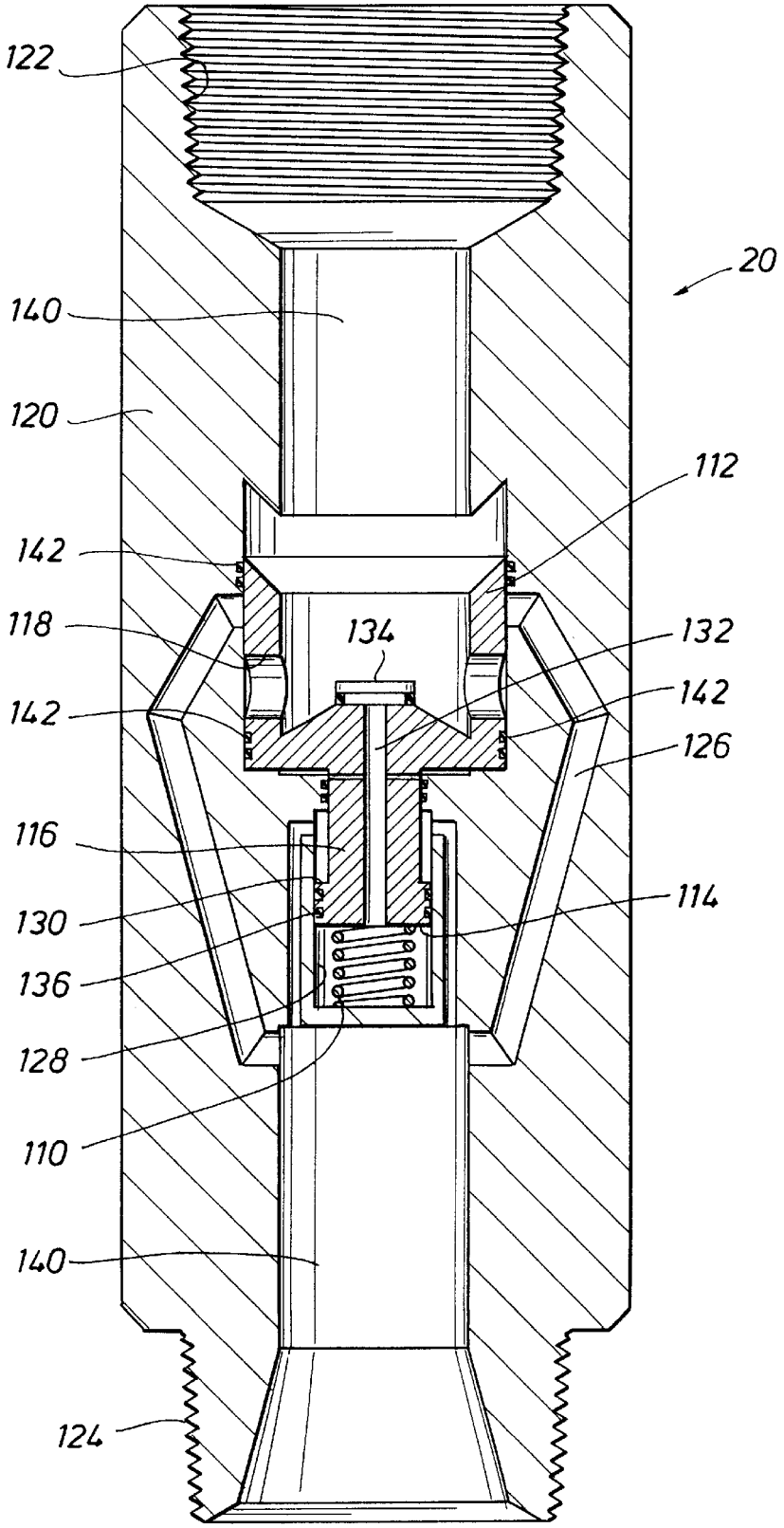
FIG. 5 is a longitudinally taken cross sectional view of the drill string shut-off valve of FIG. 2 in a closed position.

FIG. 5 details a DSSOV 20 deployed at the base of drill string 34 as part of bottom hole assembly 42 in FIG. 2. The DSSOV is an automatic valve which uses ported piston pressures/spring balance to throw a valve 112 for containing the hydrostatic head of drilling fluid 32 within the drill string when the bottom hole assembly is in place and the normal circulation of the drilling fluid is interrupted, e.g., to make up another section of drill pipe into the drill string. In such instances the DSSOV closes to prevent the drilling fluid from running down and out of the drill string and up the annulus 46, displacing the much lighter seawater until equilibrium is reached. See FIG. 2.

Figure 6:
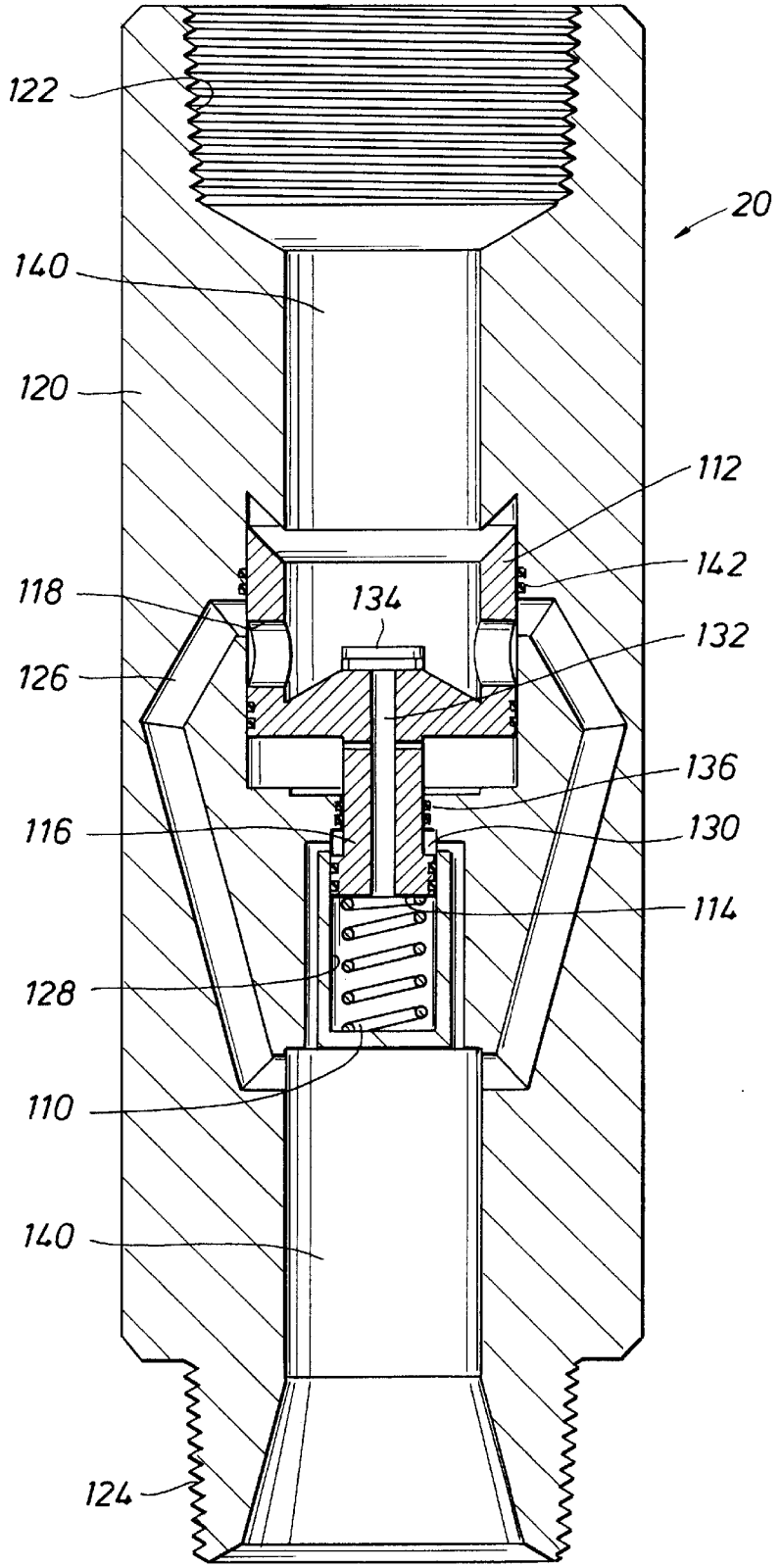
FIG. 6 is a longitudinally taken cross sectional view of the drill string shut-off valve of FIG. 2 in an open position.

FIGS. 5 and 6 illustrate DSSOV 20 in the closed and open positions, respectively. The DSSOV has a main body 120 and may be conveniently provided with connectors such as a threaded box 122 and pin 124 on either end to make up into the drill string in the region of the bottom hole assembly. The body 120 presents a cylinder 128 which receives a piston 116 having a first pressure face 114 and a second pressure face 130. First pressure face 114 is presented on the face of the piston and is ported to the upstream side of DSSOV 20 through channel 132 passing through the piston. Channel 132 may be conveniently fitted with a trash cap 134.

Second pressure face 130 is on the back side of piston 116 and is ported to the downstream side of DSSOV 20. In this illustrated embodiment it is ported to the bore below the valve. Further, the first and second pressure faces of piston 116 are isolated by o-rings 136 slidingly sealing between the piston and the cylinder.

Body 120 also has a main flow path 140 interrupted by valve 112, but interconnected by drilling mud flow channels 126 and a plurality of o-rings 142 between valve 112 and body 120 isolate flow from drilling mud flow channels 126 except through ports 118.

The DSSOV is used to maintain a positive surface drill pipe pressure at all times. When the surface mud pump system 30 (see FIG. 1) is shut off, e.g., to add a section of drill pipe 34 as drilling progresses, valve shut-off spring 110 shuttles valve 112 to a closed position in which valve ports 118 are taken out of alignment with drilling mud flow channels 126 in body 120. See FIG. 5. The spring 110, the surface area of first pressure face 114, and the surface area of the second pressure face 130 of piston 116 are balanced in design to close valve 112 to maintain the pressure margin created by the differences in density between seawater 48 and mud 32 over the distance between surface 14 and ocean floor 18. See FIG. 1. This holds the excess positive pressure in drill pipe 34, keeping it from dissipating by driving drilling mud down the drill pipe and up annulus 46, while isolating the excess pressure from borehole 16. See FIG. 2.

After a the new drill pipe section has been made up or drilling is otherwise ready to resume, surface pump system 30 (FIG. 1) is used to build pressure on valve 112 until the pressure on face 114 of piston 116 overcome the bias of spring 110, opening valve 112 and resuming circulation. See FIG. 6.

DSSOV 20 also facilitates a method of determining the necessary mud weight in a well control event. With the DSSOV closed, pump pressure is slowly increased while monitoring carefully for signs of leak-off which is observed as an interruption of pressure building despite continued pump operation. This signals that flow has been established and the pressure is recorded as the pressure to open the DSSOV. Surface pump system 30 is then brought up to kill speed and the circulating pressures are recorded. Kill speed is a reduced pump rate employed to cycle out well fluids while carefully monitoring pressures to prevent additional influx from the formation. The opening pressure, kill speed and circulating pressure are each recorded periodically or when a significant mud weight adjustment has been made.

With such current information, the bottom hole pressure can be determined should a well control event occur. Shutting of surface pump system 30 after a flow is detected will close off DSSOV 20. The excess pressure causing the event, that is the underbalanced pressure of the formation, will add to the pressure needed to open valve 112. Pump pressure is then reapplied and increased slowly, monitoring for a leak-off signaling the resumption of flow. The pressure difference between the pre-recorded opening pressure and the pressure after flow is the underbalanced pressure that must be compensated for with adjustments in the density of mud 32. The kill mud weight is then calculated and drilling and adjustments are made accordingly in the mud formulation.

In the illustrated embodiment, some of the components of the subsea primary processing system 22 are provided on the marine drilling riser 36 and others are set directly on ocean floor 18. As to components which are set on the ocean floor, it may be useful to deploy a minimal template or at least interlocking guideposts and receiving funnels to key components placed as subsea packages into secure, prearranged relative positions. This facilitates making connections between components placed as separate subsea packages with remotely operated vehicles ("ROV"). Such connections include electric lines, gas supply lines, mud transport lines, and cuttings transport lines. A system of gas supply lines (not shown) supply each of the dry chambers 72, 72A, and 92 to compensate for the volumetric compression of gas in the open bottomed dry chambers when air trapped at atmospheric pressure at the surface is submerged to great depths. Other combinations of subsea primary processing components and their placement are possible. Further, some components may be deployed on the return riser 50 analogous to the deployment on marine drilling riser 36.

Figure 7A:
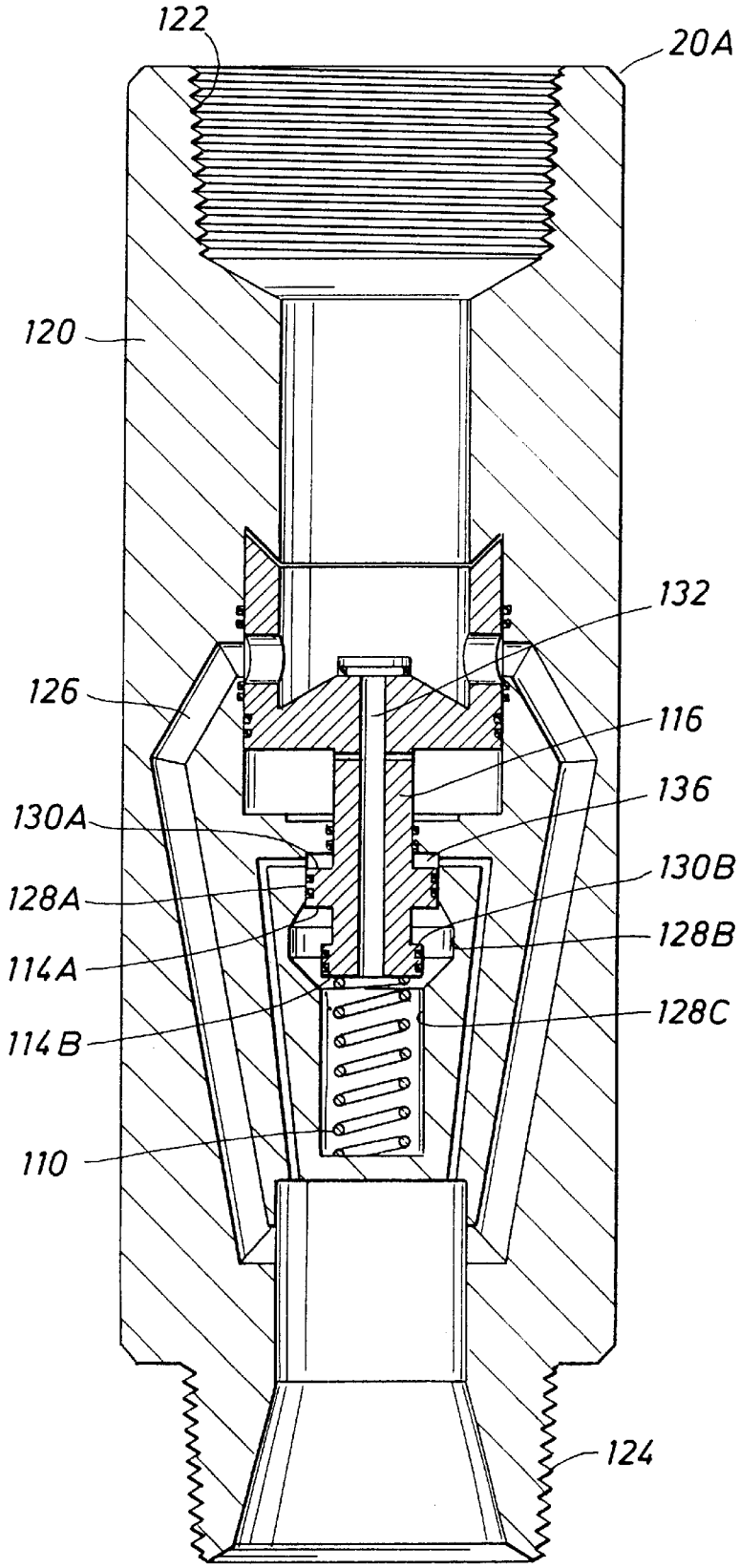
FIGS. 7A–7C are longitudinally taken cross sections of another embodiment of a drill string shut-off.
Figure 7B:
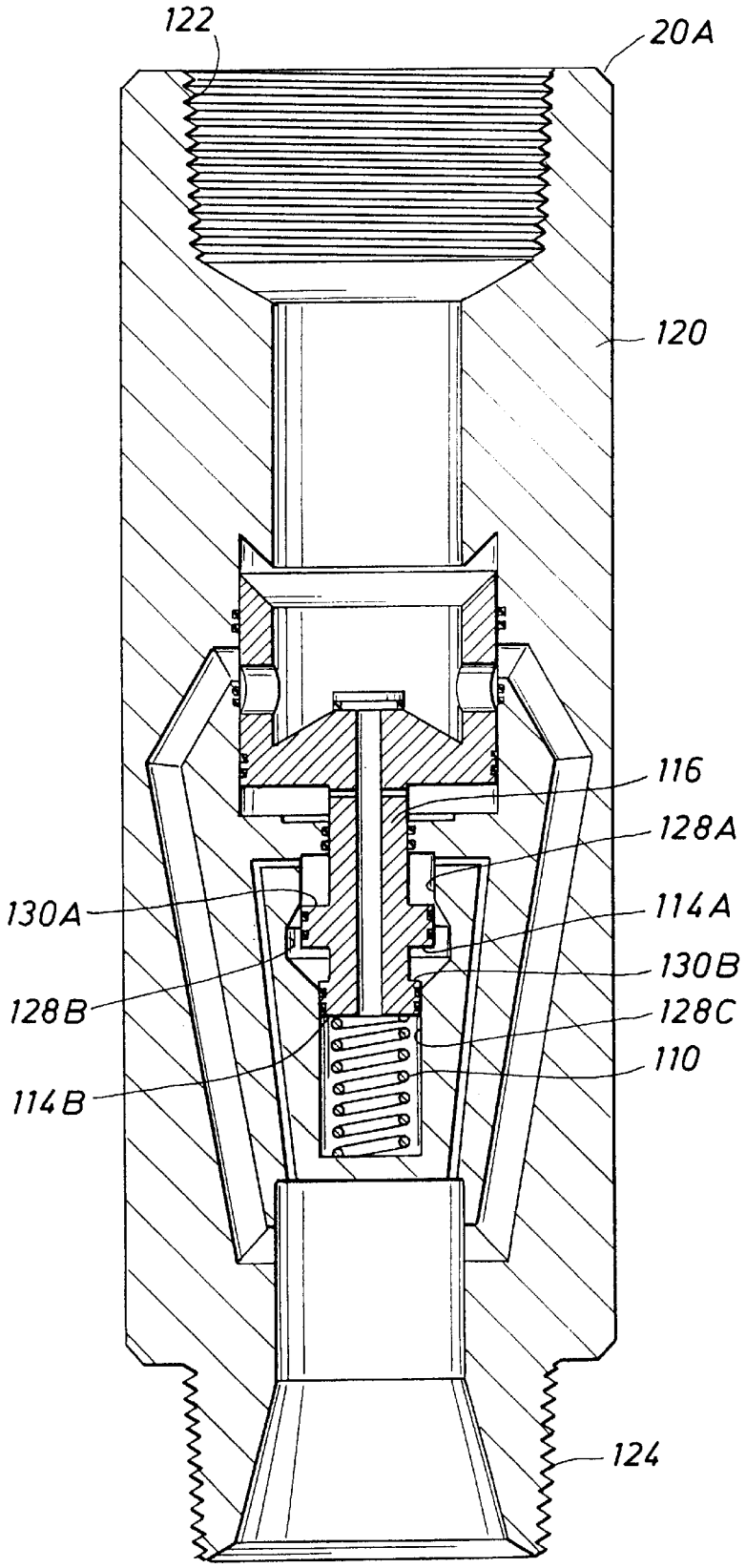
Figure 7C:
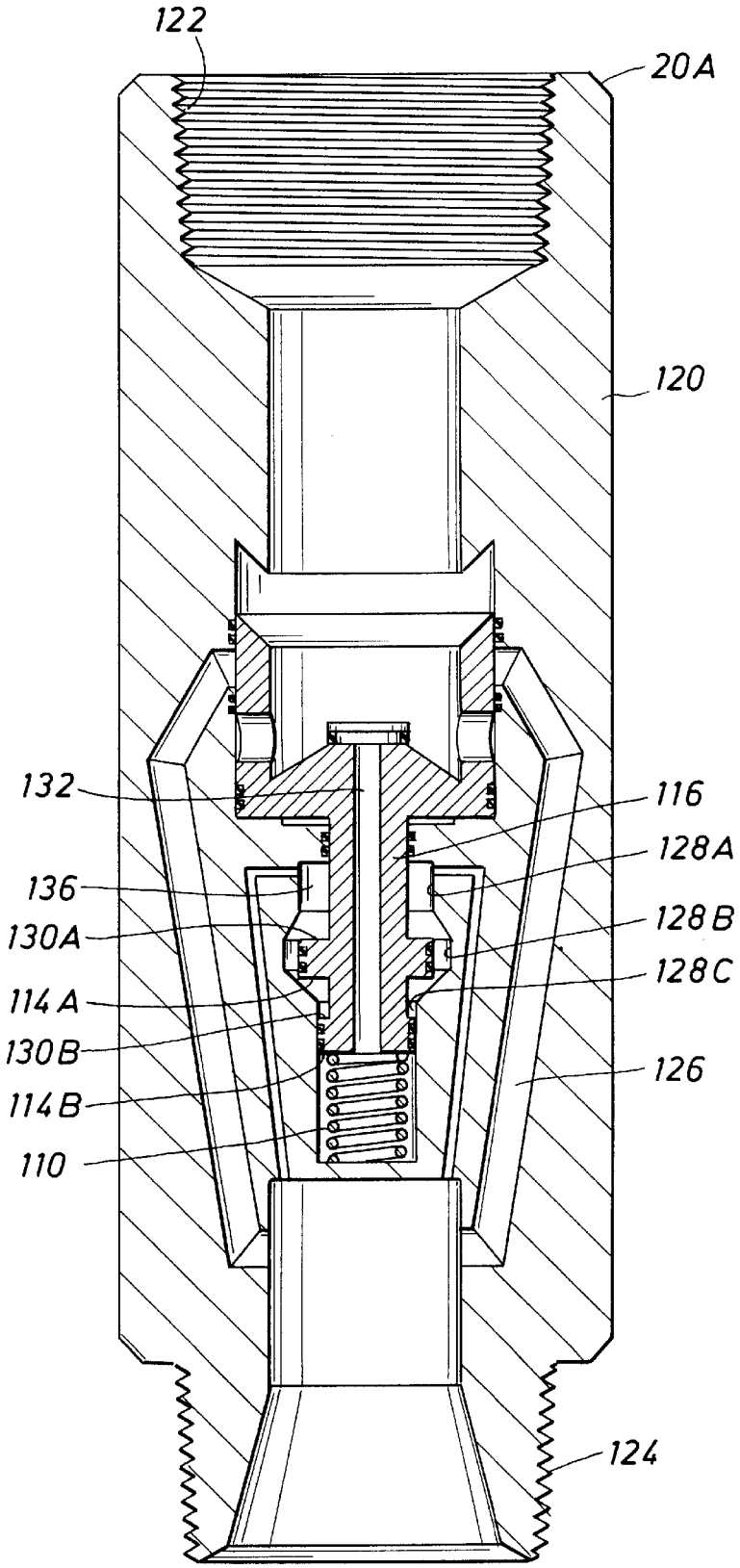

FIGS. 7A–7C illustrate another DSSOV embodiment, DSSOV 20A, in full open, intermediate, and closed positions, respectively. The DSSCOV cylinder has three regions, 128A, 128B and 128C. An additional profile in piston 116 provides paired large and small pressure faces as first pressure faces, 114A and 114B paired with corresponding second pressure faces 130A and 130B. Pressure faces 130A and 114A engage region 128A of the cylinder during normal mud circulation. Pressure faces 130A and 114A have a greater area than pressure faces 130B and 114B. This means that a lower pressure differential will keep valve 112 open. However, when the balance shifts such that the DSSOV starts to close, pressure faces 130A and 114B disengage from a sealing relationship with the cylinder walls in region 128A as the piston moves and these faces align with large diameter region 128B. The smaller area pressure faces 130B and 114B are then aligned in a sealing relationship with a reduced region 128C of the cylinder.

Other modifications, changes, and substitutions are also intended in the foregoing disclosure. Further, in some instances, some features of the present invention will be employed without a corresponding use of other features described in these illustrative embodiments. Accordingly, it is appropriate that the appended claims be construed broadly and in a manner consistent with the spirit and scope of the invention herein.

What is claimed is:

1. A method for offshore drilling comprising:

driving a bit mounted at a far end of a drill string;

injecting a drilling fluid into the drill string from surface drilling facilities;

flushing the borehole at the bit and entraining cuttings into the drilling fluid;

treating the drilling fluid through a subsea primary processing stage and thereby removing the cuttings from the drilling fluid; and returning the treated drilling fluid to the surface with a subsea return pump system.

2. A method for offshore drilling in accordance with claim 1, further comprising passing the returned drilling fluid to the surface drilling facilities for reinjection.

3. A method for offshore drilling in accordance with claim 2 wherein treating the drilling fluid through the subsea primary processing stage further comprises:

passing the drilling fluid into an ambient pressure gas chamber near the sea floor through a weir;

separating the cuttings at gumbo rails and passing the drilling fluid to a collection basin; and transporting the cuttings away from the subsea facilities for disposal.

4. A method for offshore drilling in accordance with claim 3 wherein transporting the cuttings away from the subsea facilities for disposal further comprises:

dropping the cuttings off the end of the gumbo rails into the ocean out an open bottom of the ambient pressure gas chamber;

collecting the cuttings in a discharge ditch below the open bottom of the ambient pressure gas chamber; and drawing the cuttings out of the cuttings discharge ditch with a jet pump and propelling the cuttings to a dump site away from the subsea facilities through a cuttings discharge line.

5. A method for offshore drilling in accordance with claim 4, wherein treating the drilling fluid through the subsea primary stage further comprises:

separating any gas entering the drilling fluid from the formation during a well event upstream of the subsea return pump system.

6. A method for offshore drilling in accordance with claim 5, further comprising:

treating the drilling fluid after return to the surface in a surface secondary processing stage to remove gas and cutting fines before advancing the drilling fluid to a surface pump system for recirculation.

7. A method for offshore drilling in accordance with claim 5 further comprising collecting the treated drilling fluid in a reservoir connected to a suction line of the subsea return pump system.

8. A method for offshore drilling in accordance with claim 7 wherein the collection basin of the subsea primary processing stage has a significant volume in relation to the flow of the drilling fluid and collecting the treated drilling fluid in a reservoir connected to the suction line of the subsea return pump system comprises passing the treated drilling fluid to the collection basin.

9. A method for offshore drilling in accordance with claim 7 further comprising controlling the operation of the subsea return pump system with a liquid level control associated with the reservoir.

10. A method for offshore drilling in accordance with claim 7 wherein returning the treated drilling fluid to the surface further comprises pumping the treated drilling fluid up a return riser.

11. A method for offshore drilling in accordance with claim 7, further comprising selectively isolating the hydrostatic head from the mud in the drill string from the relatively lesser ambient pressure at the sea floor seen at the mud exit return line with a pressure activated drill string shut-off valve when drilling fluid circulation is interrupted.

12. A method for offshore drilling in accordance with claim 11 further comprising purging the ambient pressure gas chambers for the gumbo box and the subsea return pump system with a gas.

13. A method for offshore drilling in accordance with claim 11 wherein purging the ambient pressure gas chambers for the gumbo box and the subsea return pump system with a gas comprises injecting air from a high pressures source.

14. A method for offshore drilling in accordance with claim 11 wherein purging the ambient pressure gas chambers for the gumbo box and the subsea return pump system with a gas comprises injecting nitrogen from a high pressure source.

15. A method for offshore drilling in accordance with claim 1 further comprising passing the drilling fluid through a drill string shut-off valve at the far end of the drill string.

16. A method for offshore drilling in accordance with claim 15, further comprising passing the returned drilling fluid to the surface drilling facilities for reinjection.

17. A method for offshore drilling in accordance with claim 16 wherein treating the drilling fluid through the subsea primary processing stage further comprises:

passing the drilling fluid into an ambient pressure gas chamber near the sea floor through a weir;

separating the cuttings at gumbo rails and passing the drilling fluid to a collection basin; and transporting the cuttings away from the subsea facilities for disposal.

18. A method for offshore drilling in accordance with claim 17 wherein transporting the cuttings away from the subsea facilities for disposal further comprises:

dropping the cuttings off the end of the gumbo rails into the ocean out an open bottom of the ambient pressure gas chamber;

collecting the cuttings in a discharge ditch below the open bottom of the ambient pressure gas chamber; and drawing the cuttings out of the cuttings discharge ditch with a jet pump and propelling the cuttings to a dump site away from the subsea facilities through a cuttings discharge line.

19. A method for offshore drilling in accordance with claim 18, wherein treating the drilling fluid through the subsea primary stage further comprises:

separating any gas entering the drilling fluid from the formation during a well event upstream of the subsea return pump system.

20. A method for offshore drilling in accordance with claim 19, further comprising:

treating the drilling fluid after return to the surface in a surface secondary processing stage to remove gas and cutting fines before advancing the drilling fluid to the surface pump system for recirculation.

21. A method for offshore drilling in accordance with claim 19 further comprising collecting the treated drilling fluid in a reservoir connected to a suction line of the subsea return pump system.

22. A method for offshore drilling in accordance with claim 21 wherein the collection basin of the subsea primary processing stage has a significant volume in relation to the flow of the drilling fluid and collecting the treated drilling fluid in a reservoir connected to the suction line of the subsea return pump system comprises passing the treated drilling fluid to the collection basin.

23. A method for offshore drilling in accordance with claim 21 further comprising controlling the operation of the subsea return pump system with a liquid level control associated with the reservoir.

24. A method for offshore drilling in accordance with claim 21 wherein returning the treated drilling fluid to the surface further comprises pumping the treated drilling fluid up a return riser.

25. A method for offshore drilling in accordance with claim 21, further comprising selectively isolating the hydrostatic head from the mud in the drill string from the relatively lesser ambient pressure at the sea floor seen at the mud exit return line with a pressure activated drill string shut-off valve when drilling fluid circulation is interrupted.

26. A method for offshore drilling in accordance with claim 25 further comprising purging the ambient pressure gas chambers for the gumbo box and the subsea return pump system with a gas.

27. A method for offshore drilling in accordance with claim 25 wherein purging the ambient pressure gas chambers for the gumbo box and the subsea return pump system with a gas comprises injecting air from a high pressures source.

28. A method for offshore drilling in accordance with claim 25 wherein purging the ambient pressure gas chambers for the gumbo box and the subsea return pump system with a gas comprises injecting nitrogen from a high pressure source.

29. An offshore drilling system comprising:

a drill string;

a bit at the far end of the drill string;

a blow out preventor mounted on a well head near the sea floor through which the drill string passes;

a drilling fluid injected into the drill string from surface drilling facilities;

a mud return line above the blow out preventor to receive the drilling fluid and entrained cuttings substantially at the sea floor;

a subsea primary processing stage connected to the mud return line for treating the drilling fluid by removing the cuttings from the drilling fluid in a subsea operation;

a subsea return pump system receiving the treated drilling fluid; and a return line through which the treated drilling fluid is returned to the surface.

30. An offshore drilling system in accordance with claim 29, further comprising a drill string shut-off valve at the far end of the drill string, above the bit.

31. A method for offshore drilling comprising:

driving a bit mounted at a far end of a drill string;

injecting a drilling fluid into the drill string from surface drilling facilities;

flushing the borehole at the bit and entraining cuttings into the drilling fluid;

treating the drilling fluid through a subsea primary processing stage and thereby removing the cuttings from the drilling fluid, comprising:

passing the drilling fluid into an ambient pressure gas chamber near the sea floor through a weir;

separating the cuttings at gumbo rails and passing the drilling fluid to a collection basin; and transporting the cuttings away from the subsea facilities for disposal;

returning the treated drilling fluid to the surface with a subsea return pump system; and passing the returned drilling fluid to surface drilling facilities for reinjection.

32. A method for offshore drilling in accordance with claim 31 wherein transporting the cuttings away from the subsea facilities for disposal further comprises:

dropping the cuttings off the end of the gumbo rails into the ocean out an open bottom of the ambient pressure gas chamber;

collecting the cuttings in a discharge ditch below the open bottom of the ambient pressure gas chamber; and drawing the cuttings out of the cuttings discharge ditch with a jet pump and propelling the cuttings to a dump site away from the subsea facilities through a cuttings discharge line.

33. A method for offshore drilling in accordance with claim 32, wherein treating the drilling fluid through the subsea primary stage further comprises:

separating any gas entering the drilling fluid from the formation during a well event upstream of the subsea return pump system.

34. A method for offshore drilling in accordance with claim 33, further comprising:

treating the drilling fluid after return to the surface in a surface secondary processing stage to remove gas and cutting fines before advancing the drilling fluid to a surface pump system for recirculation.

35. A method for offshore drilling in accordance with claim 33 further comprising collecting the treated drilling fluid in a reservoir connected to a suction line of the subsea return pump system.

36. A method for offshore drilling in accordance with claim 35 wherein the collection basin of the subsea primary processing stage has a significant volume in relation to the flow of the drilling fluid and collecting the treated drilling fluid in a reservoir connected to the suction line of the subsea return pump system comprises passing the treated drilling fluid to the collection basin.

37. A method for offshore drilling in accordance with claim 35 further comprising controlling the operation of the subsea return pump system with a liquid level control associated with the reservoir.

38. A method for offshore drilling in accordance with claim 35 wherein returning the treated drilling fluid to the surface further comprises pumping the treated drilling fluid up a return riser.

39. A method for offshore drilling in accordance with claim 35, further comprising selectively isolating the hydrostatic head from the mud in the drill string from the relatively lesser ambient pressure at the sea floor seen at the mud exit return line with a pressure activated drill string shut-off valve when drilling fluid circulation is interrupted.

40. A method for offshore drilling in accordance with claim 39 further comprising purging the ambient pressure gas chambers for the gumbo box and the subsea return pump system with a gas.

41. A method for offshore drilling in accordance with claim 39 wherein purging the ambient pressure gas chambers for the gumbo box and the subsea return pump system with a gas comprises injecting air from a high pressures source.

42. A method for offshore drilling in accordance with claim 39 wherein purging the ambient pressure gas chambers for the gumbo box and the subsea return pump system with a gas comprises injecting nitrogen from a high pressure source.

43. A method for offshore drilling comprising:

driving a bit mounted at a far end of a drill string;

injecting a drilling fluid into the drill string from surface drilling facilities;

passing the drilling fluid through a drill string shut-off valve at the far end of the drill string;

flushing the borehole at the bit and entraining cuttings into the drilling fluid;

treating the drilling fluid through a subsea primary processing stage and thereby removing the cuttings from the drilling fluid, comprising:

passing the drilling fluid into an ambient pressure gas chamber near the sea floor through a weir;

separating the cuttings at gumbo rails and passing the drilling fluid to a collection basin; and transporting the cuttings away from the subsea facilities for disposal;

returning the treated drilling fluid to the surface with a subsea return pump system; and passing the returned drilling fluid to surface drilling facilities for reinjection.

44. A method for offshore drilling in accordance with claim 43 wherein transporting the cuttings away from the subsea facilities for disposal further comprises:

dropping the cuttings off the end of the gumbo rails into the ocean out an open bottom of the ambient pressure gas chamber;

collecting the cuttings in a discharge ditch below the open bottom of the ambient pressure gas chamber; and drawing the cuttings out of the cuttings discharge ditch with a jet pump and propelling the cuttings to a dump site away from the subsea facilities through a cuttings discharge line.

45. A method for offshore drilling in accordance with claim 44, wherein treating the drilling fluid through the subsea primary stage further comprises:

separating any gas entering the drilling fluid from the formation during a well event upstream of the subsea return pump system.

46. A method for offshore drilling in accordance with claim 45, further comprising:

treating the drilling fluid after return to the surface in a surface secondary processing stage to remove gas and cutting fines before advancing the drilling fluid to the surface pump system for recirculation.

47. A method for offshore drilling in accordance with claim 45 further comprising collecting the treated drilling fluid in a reservoir connected to a suction line of the subsea return pump system.

48. A method for offshore drilling in accordance with claim 47 wherein the collection basin of the subsea primary processing stage has a significant volume in relation to the flow of the drilling fluid and collecting the treated drilling fluid in a reservoir connected to the suction line of the subsea return pump system comprises passing the treated drilling fluid to the collection basin.

49. A method for offshore drilling in accordance with claim 47 further comprising controlling the operation of the subsea return pump system with a liquid level control associated with the reservoir.

50. A method for offshore drilling in accordance with claim 47 wherein returning the treated drilling fluid to the surface further comprises pumping the treated drilling fluid up a return riser.

51. A method for offshore drilling in accordance with claim 47, further comprising selectively isolating the hydrostatic head from the mud in the drill string from the relatively lesser ambient pressure at the sea floor seen at the mud exit return line with a pressure activated drill string shut-off valve when drilling fluid circulation is interrupted.

52. A method for offshore drilling in accordance with claim 51 further comprising purging the ambient pressure gas chambers for the gumbo box and the subsea return pump system with a gas.

53. A method for offshore drilling in accordance with claim 51 wherein purging the ambient pressure gas chambers for the gumbo box and the subsea return pump system with a gas comprises injecting air from a high pressures source.

54. A method for offshore drilling in accordance with claim 51 wherein purging the ambient pressure gas chambers for the gumbo box and the subsea return pump system with a gas comprises injecting nitrogen from a high pressure source.

55. An offshore drilling system comprising:

a drill string;

a drill string shut-off valve at the far end of the drill string;

a bit at the far end of the drill string, below the drill string shut-off valve;

a blow out preventor mounted on a well head near the sea floor through which the drill string passes;

a drilling fluid injected into the drill string from surface drilling facilities;

a mud return line above the blow out preventor to receive the drilling fluid and entrained cuttings substantially at the sea floor;

a subsea primary processing stage connected to the mud return line for treating the drilling fluid by removing the cuttings from the drilling fluid in a subsea operation;

a subsea return pump system receiving the treated drilling fluid; and a return line through which the treated drilling fluid is returned to the surface.

* * * * *